US005926975A

United States Patent [19]

Goodman et al.

[11] Patent Number: 5,926,975

[45] Date of Patent: Jul. 27, 1999

[54] HINGED SHOE SOLE ASSEMBLY FOR WORKING BOOTS

[76] Inventors: Michael C. Goodman, 2949 Yearling St., Lakewood, Calif. 90712; Ker-Shih Ning, 8653 Los Coyotes Dr., Buena Park, Calif. 90621

[21] Appl. No.: 09/018,218

[22] Filed: Feb. 3, 1998

Related U.S. Application Data

[63] Continuation-in-part of application No. 08/819,483, Mar. 17, 1997, abandoned.

[51] Int. Cl.[6] ..... A43B 13/14; A43B 13/08

[52] U.S. Cl. ..... 36/31; 36/33

[58] Field of Search ..... 36/25 R, 36 R, 36/28, 32 R, 102, 31, 30 R, 33

[56] References Cited

U.S. PATENT DOCUMENTS

| | | |
|---|---|---|
| Re. 32,394 | 4/1987 | Ehrlich . |
| 1,268,199 | 6/1918 | Zavarkin . |
| 1,493,565 | 5/1924 | Raboni . |
| 1,528,265 | 3/1925 | Roa . |
| 1,964,364 | 6/1934 | Pellkofer . |
| 1,964,406 | 6/1934 | Pellkofer . |
| 1,964,705 | 6/1934 | Pellkofer . |
| 2,126,077 | 8/1938 | Youngberg . |
| 2,129,099 | 9/1938 | Pearson . |
| 2,157,818 | 5/1939 | Disch . |
| 2,177,571 | 10/1939 | Kirke . |
| 2,239,471 | 4/1941 | Srajer . |
| 2,352,532 | 6/1944 | Ghez et al. . |
| 2,450,250 | 9/1948 | Napton . |
| 2,466,580 | 4/1949 | Dalbey . |
| 2,478,664 | 8/1949 | Morrow et al. . |
| 2,517,472 | 8/1950 | Fathauer . |
| 2,590,648 | 3/1952 | Pitz . |
| 2,599,970 | 6/1952 | Barrons . |
| 2,707,341 | 5/1955 | Romano . |
| 3,032,895 | 5/1962 | Goldberg . |
| 3,063,167 | 11/1962 | Scholl . |
| 3,121,962 | 2/1964 | Gullo . |
| 3,152,408 | 10/1964 | Thiessen . |
| 3,178,835 | 4/1965 | Burke et al. . |
| 3,266,177 | 8/1966 | Holden . |
| 3,455,038 | 7/1969 | Kasdan . |
| 3,464,126 | 9/1969 | Sarkissian . |
| 3,478,447 | 11/1969 | Gillead . |
| 3,481,053 | 12/1969 | De Felice . |
| 4,059,910 | 11/1977 | Bryden et al. . |
| 4,177,582 | 12/1979 | Ehrlich Jr. . |
| 4,262,435 | 4/1981 | Block et al. . |
| 4,309,832 | 1/1982 | Hunt . |
| 4,377,041 | 3/1983 | Alchermes . |
| 4,400,893 | 8/1983 | Musci . |
| 4,400,894 | 8/1983 | Ehrlich . |
| 4,403,426 | 9/1983 | Kaplan . |
| 4,416,072 | 11/1983 | Sarkissian . |
| 4,424,635 | 1/1984 | Jourdan . |
| 4,443,956 | 4/1984 | Caccavale . |
| 4,476,638 | 10/1984 | Quacquarwi et al. . |
| 4,494,323 | 1/1985 | Latraverse . |
| 4,562,651 | 1/1986 | Frederick et al. . |
| 4,573,457 | 3/1986 | Parks . |
| 4,615,126 | 10/1986 | Mathews . |

(List continued on next page.)

FOREIGN PATENT DOCUMENTS

| | | |
|---|---|---|
| 74924 | 11/1918 | Austria . |
| 20574 | 9/1915 | Denmark . |
| 2478441 | 9/1981 | France . |
| 219669 | 3/1909 | Germany . |
| 303072 | 1/1918 | Germany . |
| 307921 | 9/1918 | Germany . |
| 82787 | 10/1919 | Switzerland . |

*Primary Examiner*—B. Dayoan

[57] ABSTRACT

A working boot designed such that the bottom of the foot of a wearer will be completely shielded by a metal sole yet still be capable of full, free movement. The shoe sole structure hinges a forward sole section to a rear sole section such that the straight hinge line passes below the lowest points of the first and fifth metatarsal heads of the foot of a wearer. It was found that, in order for a completely flat sole to work, the horizontal length of the hinge must be equal to the vertical thickness of the sole sections.

2 Claims, 6 Drawing Sheets

U.S. PATENT DOCUMENTS 4,628,936 12/1986 Langer et al. .
4,670,996 6/1987 Dill .
4,672,754 6/1987 Ehrlich .
4,805,320 2/1989 Goldenberg et al. .
4,907,351 3/1990 Hirai .
4,924,607 5/1990 Harper .
5,384,973 1/1995 Lyden .
5,410,820 5/1995 Goodman .
5,592,755 1/1997 Ehrlich .

FIG. 1
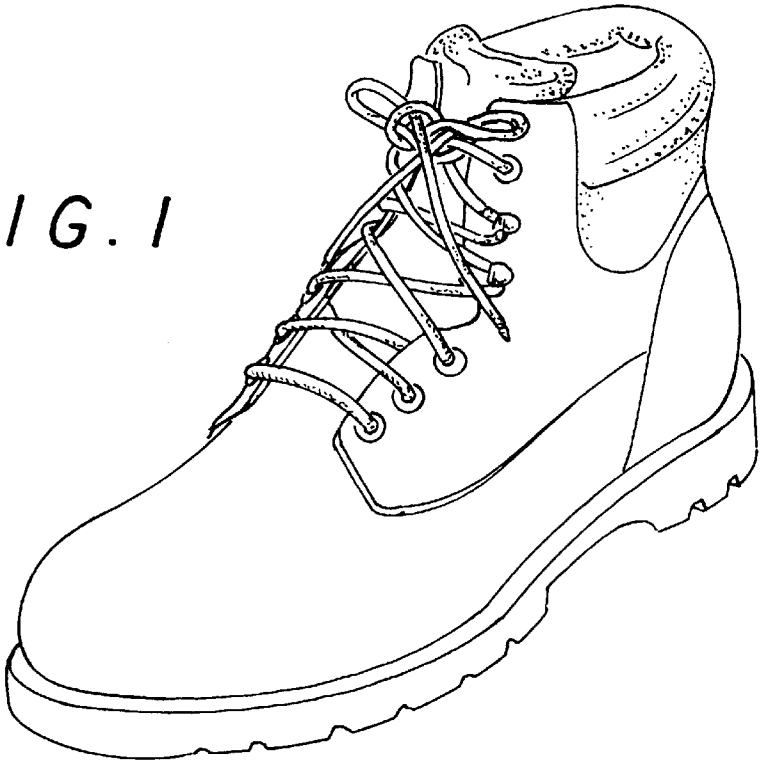
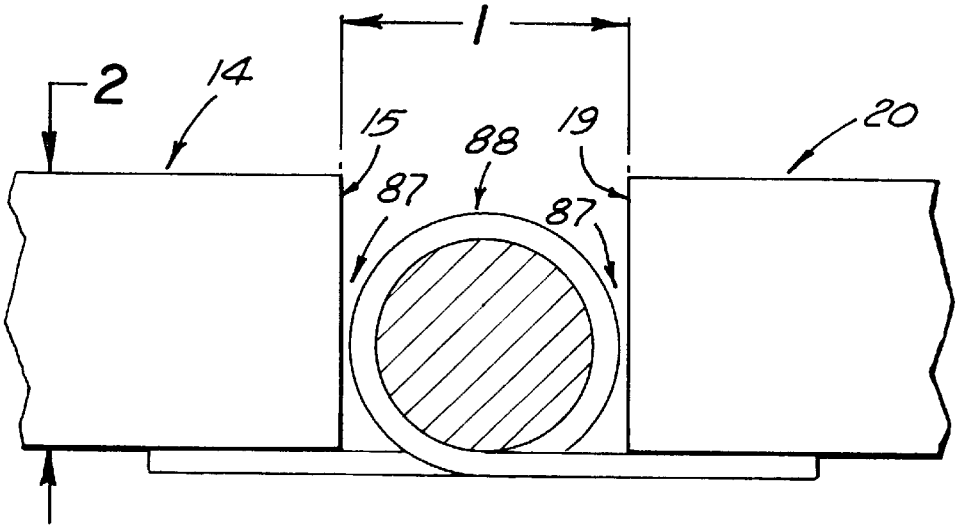
FIG. 3

HINGED SHOE SOLE ASSEMBLY FOR WORKING BOOTS

CROSS-REFERENCE TO RELATED APPLICATION

This is a continuation-in-part of U.S. application Ser. No. 08/819,483 filed Mar. 17, 1997.

BACKGROUND OF THE INVENTION

1. Field of the Invention

This invention relates generally to hinged sole shoes and, more particularly, to hinged sole working boots.

2.An Analysis of the Prior Art as Related to the Developmental History of the Invention The invention was developed by Michael C. Goodman and Ker-Shih Ning while testing another invention which is described in Michael Goodman's U.S. Pat. No. 5,410,820 dated May 2, 1995 (hereafter referred to as the inventor's prior patent). That patent describes a design for high heel shoes wherein the heels are removable and the shoes will function properly both as high heels and as flats. Experimentation has shown that, with high heels attached, such shoes are much more comfortable than conventional high heel shoes.

Historically, there has been an unsolved problem which limited the comfort and versatility of rigid sole working boots. For proper protection of the foot, such shoes have a completely rigid steel sole and a steel cap above the toes. Before the research described in the inventor's prior patent, nobody in the shoe industry recognized that it was possible to completely shield the bottom of the foot with a metal sole yet provide for full, free movement. Thus, conventional working boots do not provide for proper flexing of the foot which seriously limits their comfort and utility.

Experiments with dozens of prototypes tested by several hundred people confirm that it is possible to make a shoe sole out of rigid components that feels like a flexible sole made out of soft materials. Two rigid sole components must be hinged together along the natural hinge line of the foot which is shown in FIG. 7A of the inventor's prior patent. Any normal foot flexes along a line that passes below the lowest point of the first metatarsal head 31 and the lowest point of the fifth metatarsal head 32.

This line can be found by using the following geometrical technique. Draw a line through the two points of a sole perimeter that are furthest apart to get the longitudinal axis 7 seen in FIG. 2. Next, draw a line 71 parallel to the longitudinal axis on the medial side of the sole perimeter passing through the point 8 furthest from the longitudinal axis. Then, draw a line 72 parallel to the longitudinal axis on the lateral side of the sole perimeter passing through the point 9 furthest from the longitudinal axis. The line 30 connecting points 8 and 9 exactly matches the natural hinge line of the foot. It has been found that if two rigid sole components are hinged together as in FIG. 8 of the inventor's prior patent or FIG. 2 of this disclosure, a shoe with such a sole will feel like a flexible, soft-soled shoe.

Thus, the inventors saw the potential of using such a hinged sole assembly to respond to the long felt but unsolved need for a working boot with a metal sole that fully shields the bottom of the foot but which provides for full, free movement. In trying to use hinged shoe sole assemblies built in accordance with the inventor's prior patent for this purpose, certain problems were encountered that required a great deal of time and expense to solve. The technical solution to those problems constitutes the new invention which is being described in this disclosure.

The shoe design uses sole components made out of metal so weight is a critical factor. The sole sections need to be as thin as possible but not so thin that they will bend or become distorted during use. During prototype construction, the sole sections used were thinner than the hinges readily available to the inventors. By installing the hinges as shown in FIG. 10B of the inventor's prior patent, the flanges 84 and 86 were almost flush with the top of the forward sole section 14 and the top of the rear sole section 20. With a little bit of padding, the soles felt smooth. The hinge barrel diameter was greater than the thickness of the sole sections so the hinge protruded below the bottom of the sole sections but despite this, these shoes still felt perfectly comfortable. FIG. 4 of this disclosure shows what the sole assembly looks like with a high heel attached.

FIG. 5 shows what the sole assembly looks like with high heels removed. Although the hinge 24 protrudes slightly below the bottom of the sole sections 14 and 20, the threaded fastening pin 66 lifts the rear sole section 20 up high enough so that the hinge is not felt. In order to use the hinged sole assembly in a working boot, the threaded fastening pin 66 had to be removed and this is where the inventors first encountered problems. FIG. 6 shows the sole assembly of FIG. 5 with the threaded fastening pin 66 removed. The sole can no longer be worn because the hinge line presses painfully up into the foot. If the sole assembly is turned over as in FIG. 7, the results are even worse.

The inventors experimented by increasing the thickness of the sole sections and found that if the hinge barrel diameter is smaller than the thickness of the sole sections, the hinge will not rotate properly. FIG. 8 shows this condition with the flanges on the bottom. As is shown in FIG. 9, rotational movement is inhibited because the rear edge 100 of the upper surface of the forward sole section and the forward edge 101 of the upper surface of the rear sole section come into contact with each other and prevent full movement. FIG. 10 shows the sole assembly of FIG. 8 turned over so that the flanges are on top. During walking, an exaggerated separation occurs between the rear edge 102 of the lower surface of the forward sole section and the forward edge 103 of the lower surface of the rear sole section. For use in working boots, the bottom of the sole assembly has to be adhesively bonded to a rubber, leather or neoprene sole 50. As is shown in FIG. 11, the inventors found that the rubber, leather or neoprene sole 50 prevented the exaggerated separation needed between edges 102 and 103 for the sole to flex freely. As is seen in FIG. 1 of Danish Patent No. 20574 dated Sep. 8, 1915, D. Kapskobund encountered this problem which he corrected by putting notch "o" into the bottom of the thick wooden soles of his clogs. That notch holds a folded piece of leather which allows the exaggerated separation of the sole sections at that point. This solution can not be incorporated into a thin metal sole suitable for use in working boots although it served Kapskobund's purpose which, as described on page 7 of the inventor's prior patent, was to enable clogs to flex with the foot so they could be built with fully enclosed uppers.

The inventors found that merely matching the hinge barrel diameter to the sole thickness was not enough. As is shown in FIG. 3, it was discovered that in order for the hinge to move freely, there must be a slight gap 87 between the hinge barrels 88 and the rear face 15 of the forward sole section 14 and there must also be a slight gap 87 between the hinge barrels 88 and the forward face 19 of the rear sole section 20. If these gaps are not present, the hinge will not rotate freely due to friction between the hinge barrels and the sole sections. The inventors finally found that the shoe sole assembly would work properly if the hinge was positioned such that the distance between the rear of the forward sole section and the front of the rear sole section was equal to the thickness of the sole. Thus, as is shown in FIG. 3, the horizontal length 1 of the entire hinge means must be the same as the sole's vertical thickness 2 where hinge means is defined to be the hinge pin surrounded by the hinge barrels which are then separated by an air gap from the sole sections.

A prior art patent which needs to be addresssed is U.S. Pat. No. 2,352,532 dated Jun. 27, 1944 to H. Ghez et al. Although initial observation might suggest that the hinge line of the instant invention appears to pass through the rear sole hinge area of the sole disclosed by Ghez et al, closer analysis shows that this is not the case. In FIG. 13, the longitudinal axis 7 and the medial 71 and lateral 72 parallel lines have been superimposed on FIG. 3 of Ghez's patent. This reveals line 30 which is known to exactly match the natural hinge line of the foot. Analysis of FIG. 12, which is taken from FIG. 4 of Ghez's patent, reveals that the wooden sole flexes above the notch "f" which is the thinnest, most flexible part of the hinge mechanism. In the text of Ghez's patent on the first page, second column, lines 2 to 3, he states "a deep groove f extends upwardly a distance into the block to facilitate bending or flexing". FIG. 13 shows that Ghez's design flexes along line 161.

Bio-mechanical engineering analysis has shown that the human foot flexes along a line running below the lowest part of the ball of the foot (line 30 of FIG. 13). The foot has no flexing capability to the rear of this line because it can not bend or flex under the arch. Referring to FIG. 1 of Ghez's patent, the lowest part of the ball of the foot would rest between the hinges on the lowest part of the sole's upper surface. If a wearer's foot were bound to Ghez's sole with a fully enclosed upper, the rear hinge would not flex at all and the front hinge would allow some slight flexing of the toes but not enough to provide for a proper walking movement. Experiments have been done which prove this.

During early tests which led to the inventor's prior patent, a pair of prototypes was built that had hinged soles very similar to FIG. 3 of G. Grove's German patent No. 303072 dated Jan. 21, 1918. It was found that if a hinged sole assembly has a hinge line to the rear of the correct line, the effect is the same as if that hinge was not there and the sole was rigid. Also, Grove's design shows a hinge that does not extend through the full vertical thickness of the sole. Thus, even if such a hinge were positioned correctly, proper flexing movement would not be possible.

The inventors also built a pair of shoes with hinged soles that matched FIG. 4 of P. Baron's French Patent No. 2478441 dated Sep. 25, 1981. This design shows a hinge line well in front of the line shown in FIG. 2 of this disclosure. Wearers of these prototypes discovered that, although some slight flexing movement of the toes was possible, this flexing movement was painful and that proper movement of the foot could not be made. Also, as is shown in FIG. 2 of Baron's patent, the hinge barrel diameter is greater than the thickness of the sole sections so the hinge protrudes below the bottom of the sole sections. It has been found that such a design leads to the problem shown in FIG. 6 of this disclosure wherein the hinge line presses up into the bottom of the foot.

It has been found that hinge line 30 must be present in order for proper walking movement to be possible. Additional hinge lines can be placed to the front and/or rear of the correct line without enhancing or hindering the design. However, if the correct hinge line is not present, no combination of other lines will provide for proper flexing of the foot.

If Ghez's design were used as a sandal, it would function the same as the design shown in U.S. Pat. No. 3,063,167 dated Nov. 13, 1962 to W. M. Scholl. In Scholl's design, the entire wooden sole stays flat on the ground while the foot of the wearer flexes along hinge line 30 of FIG. 13 with the heel rising away from the sole. When the toes leave the ground during the walking movement, the sole slaps the bottom of the foot, closing the gap between heel and sole. This process is repeated with every step.

In order for a rigid, hinged sole assembly to work comfortably as a flat, it must flex along hinge line 30 and the horizontal length of the hinge means must be equal to the vertical thickness of the sole sections. If the length of the hinge means is greater than the thickness of the sole, a wearer will feel the hinge. If the length of the hinge means is less than the thickness of the sole, it will not flex properly if used with a thin sole structure. This limitation will now be explained in more detail.

In the designs of both Kapskobund and Ghez et al, the length of the hinge means is less than the thickness of the sole. During a walking motion with such a design, a large separation occurs (see FIG. 11) between the rear edge 102 of the lower surface of the forward sole section and the forward edge 103 of the lower surface of the rear sole section. Kapskobund's design has a large notch "o" and in Ghez's design "a deep groove f extends upwardly a distance into the block to facilitate bending or flexing". A thin sole structure such as the thin metal sole structure required for a working boot design does not have the space to incorporate notch "o" or groove "If".

For use in working boots, the bottom of the sole has to be bonded to a rubber, leather or neoprene sole. As is shown in FIG. 11, the inventors found that the rubber or neoprene sole 50 prevented adequate separation between edges 102 and 103 when the length of the hinge means was less than the thickness of the sole. It was found that if the horizontal length of the hinge means was equal to the vertical thickness of the sole sections, the hinged sole assembly flexed freely and the wearers were comfortable, not feeling the presence of the hinge. This design has the additional advantage that the bottom of the shoe can be flat and smooth with no groove or notch in the area of the hinge.

The inventors have used precision measuring instruments to check the dimensions of all submitted prior art designs. None of them have a horizontal hinge length equal or even approximately equal to the vertical sole thickness. This characteristic is what makes the instant invention work comfortably with a thin metal sole structure. The existance of the notches in Kapskobund's design and the deep grooves in Ghez's design show evidence of a previously unsolved problem.

SUMMARY OF THE INVENTION

A working boot designed such that the bottom of the foot of a wearer will be completely shielded by a metal sole yet still be capable of full, free movement. The shoe sole structure hinges a forward sole section to a rear sole section such that the straight hinge line passes below the lowest points of the first and fifth metatarsal heads of the foot of a wearer. It was found that, in order for a completely flat sole to work, the horizontal length of the hinge means must be equal to the vertical thickness of the sole sections. If the length of the hinge means is greater than the thickness of the sole, a wearer will feel the hinge. If the length of the hinge means is less than the thickness of the sole, it will not flex properly if used with a thin sole structure.

BRIEF DESCRIPTION OF THE DRAWINGS

FIG. 1 shows a working boot built in accordance with the invention.

FIG. 3 shows a side sectional view of a shoe sole assembly constructed in accordance with the present invention.

DESCRIPTION OF THE PREFERRED EMBODIMENTS

Figure 2:
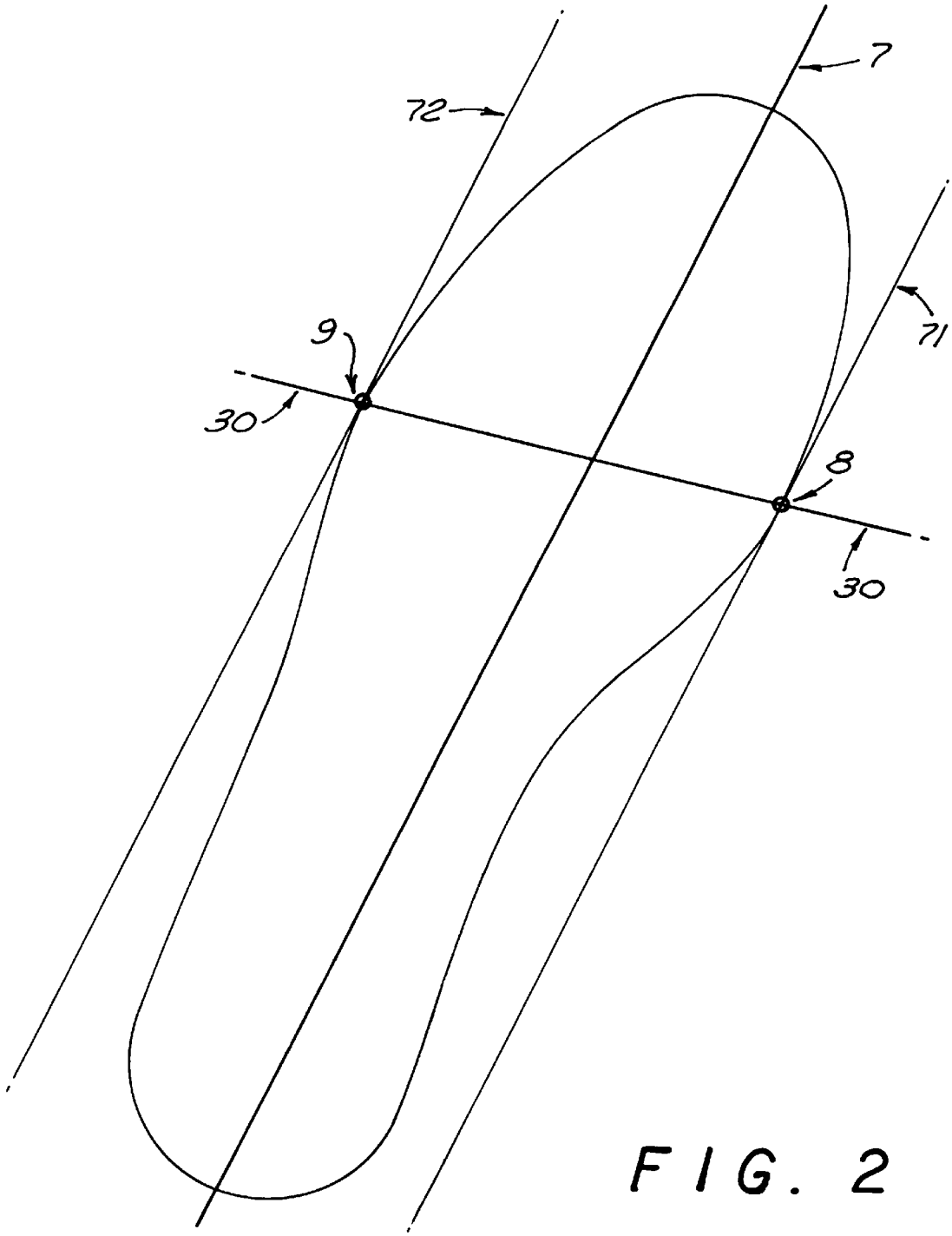
FIG. 2 shows a plan view of a shoe sole assembly constructed in accordance with the present invention.
Figure 4:
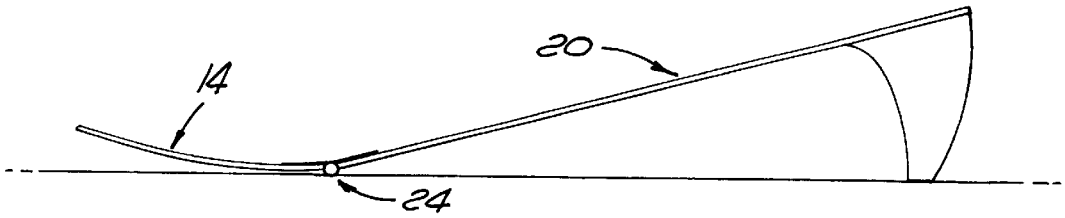
FIG. 4 PRIOR ART
FIG. 4 shows a side sectional view of a prior art shoe sole assembly.
Figure 5:
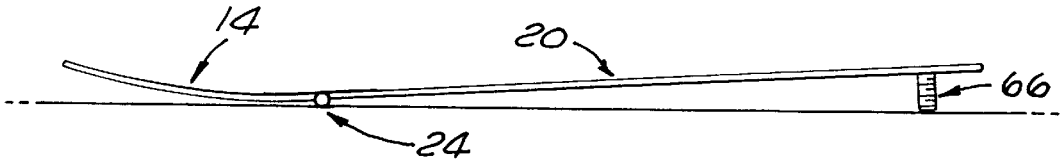
FIG. 5 PRIOR ART
FIG. 5 shows a side sectional view of a prior art shoe sole assembly.
Figure 6:
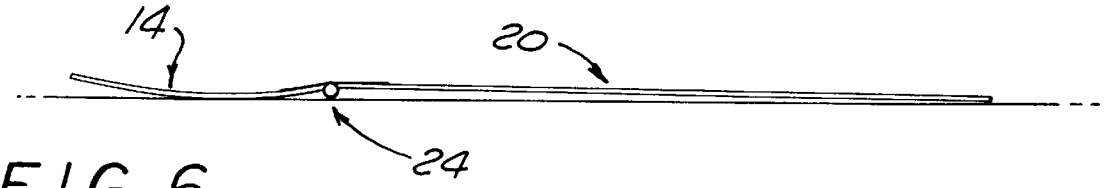
FIG. 6 shows a side sectional view of an experimental shoe sole assembly that was found not to work properly.
Figure 7:
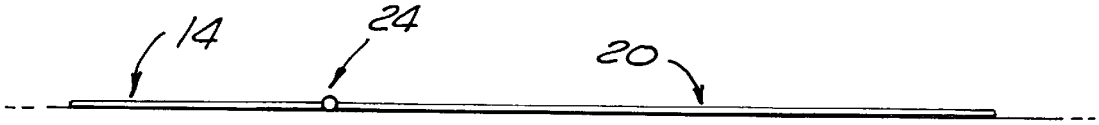
FIG. 7 shows a side sectional view of an experimental shoe sole assembly that was found not to work properly.
Figure 8:
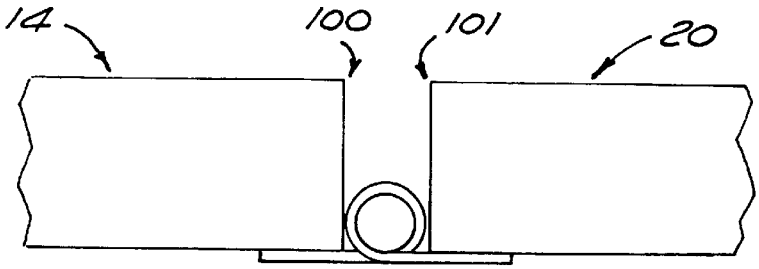
FIG. 8 shows a side sectional view of an experimental shoe sole assembly that was found not to work properly.
Figure 9:
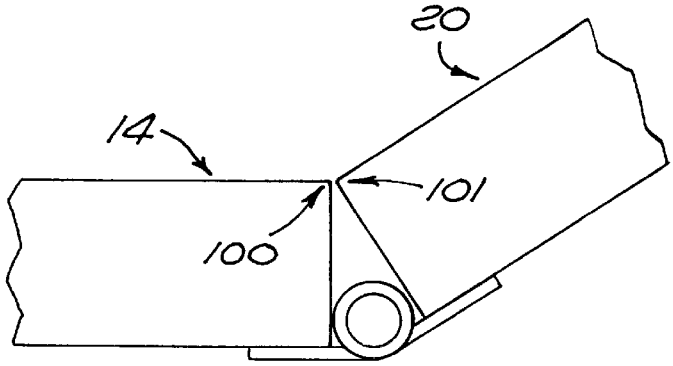
FIG. 9 shows a side sectional view of an experimental shoe sole assembly that was found not to work properly.

The invention comprises a hinged sole assembly with one precisely defined hinge line and hinge means with a horizontal length equal to the vertical thickness of the sole sections. The hinge line must be positioned so that it passes below the lowest point of the first metatarsal head and the lowest point of the fifth metatarsal head of the foot of a wearer.

A geometrical technique has been developed which will reveal the correct hinge line for any shoe size. The outline of the perimeter of a shoe sole must be traced onto a piece of paper. The best results are obtained with a design that has a rounded shape in the toe section. Draw a line through the two points of the sole perimeter that are furthest apart to get the longitudinal axis 7 seen in FIG. 2. Next, draw line 71 parallel to the longitudinal axis on the medial side of the sole perimeter passing through the point 8 furthest from the longitudinal axis. Then, draw line 72 parallel to the longitudinal axis on the lateral side of the sole perimeter passing through the point 9 furthest from the longitudinal axis. The line 30 connecting points 8 and 9 exactly matches the natural hinge line of the foot.

The geometrical and anatomical derivations of the hinge line will always match for any individual. The longest dimension of the foot projects forward to provide stability during forward bending movement (the backbone bends freely in the forward direction but almost not at all backwards). The long axis runs below the lowest point of the heel bone, below the point of connection of the bones of the foot and leg, and below the toe most adjacent to the big toe. Within each foot is a tripod support structure. The three points of this tripod are the lowest points of the heel, first metatarsal head and fifth metatarsal head. These three points provide the largest possible tripod that can be superimposed on the long axis of the foot. Two lines parallel to the long axis which bracket the foot where it is widest will thus always find the natural hinge line of the foot.

As was mentioned above, it is easiest to find the hinge line for a particular shoe size by using the geometrical technique on a rounded, pointed-toe design. After averaging numerous hinge line drawings, a prototype is built and fit-checked to an individual having the appropriate shoe size. Once the correct hinge line is known for a particular size, the design of the toe section can be changed. For example, some styles have a square toe section. It is very difficult to apply the geometrical technique of lines to such a design but, once the correct line has been found on a pointed-toe design of the same size, the line can be traced onto the square toe design. The shape of the toe section is subject to style variations but the fit between the foot and the part of the shoe rear of the hinge line never varies.

Figure 11:
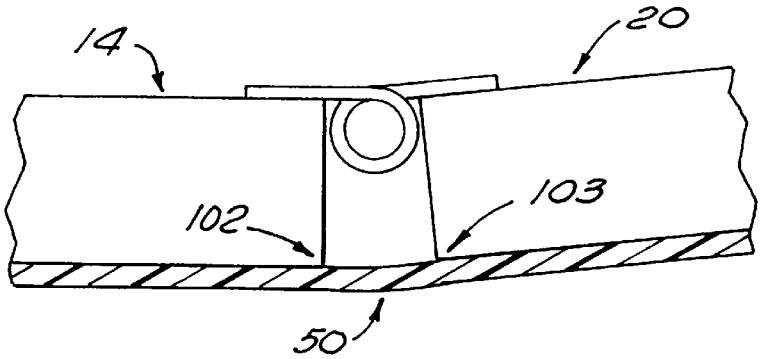
FIG. 11 shows a side sectional view of an experimental shoe sole assembly that was found not to work properly.
Figure 12:
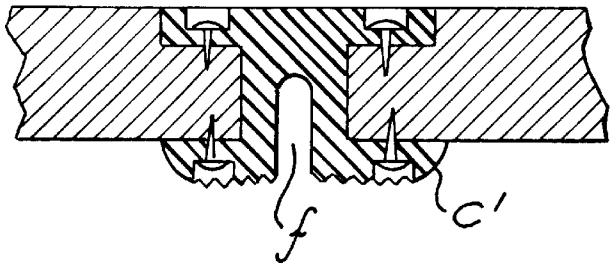
FIG. 12 PRIOR ART
FIG. 12 shows a side sectional view of a prior art patent.
Figure 13:
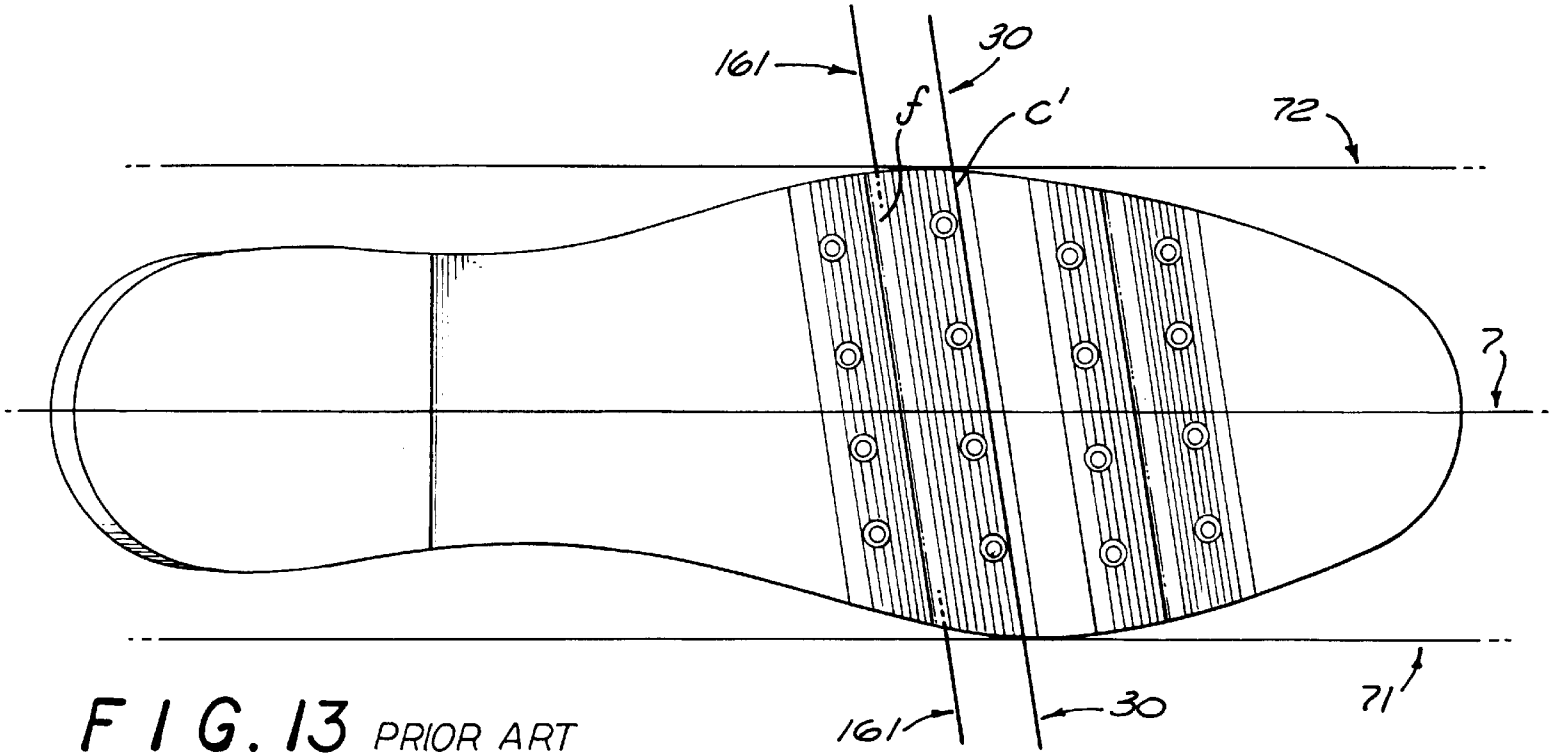
FIG. 13 PRIOR ART
FIG. 13 shows a plan view of a prior art patent.

The invention is a sole structure with the above-defined hinge line and hinge means with a horizontal length equal to the vertical thickness of the sole sections. The vertical thickness is defined to be the shortest distance between the top surface and the bottom surface of a sole section. This last characteristic was found to be necessary to enable a completely flat shoe sole to work with a hinged sole assembly. If the length of the hinge means is greater than the thickness of the sole, a wearer will feel the hinge. If the length of the hinge means is less than the thickness of the sole, it will not flex properly if used with a thin sole structure because a large separation will occur (see FIG. 11) between the rear edge 102 of the lower surface of the forward sole section and the forward edge 103 of the lower surface of the rear sole section.

Thus, the claim language specifying that the length of the hinge means should be equal to the sole thickness makes the invention applicable to thin sole structures. Such a condition can apply to a sole structure that is not thin but it is not possible to make a comfortable, flexible thin soled structure that does not have this condition. The prior art examples of Ghez and Kapskobund have notches and grooves to facilitate bending because their hinge dimensions have not been matched to their sole thicknesses. Such designs can not be made as thin as would be required to make a working boot design.

In order to convey an understanding of the present invention, it has been described above in terms of presently preferred embodiments. However, there are many configurations for hinged shoe sole assemblies that are not specifically described herein but with which the present invention is applicable. Therefore, the present invention should not be seen as limited to the particular embodiments described herein because it has applicability to a wide variety of shoe designs. All modifications, variations or equivalent arrangements that are within the scope of the attached claims should be considered to be within the scope of the invention.

As an example of a meaningless modification which will produce an equivalent arrangement, additional hinge lines can be added to either embodiment but this will not enhance the comfort of the shoe sole assembly. The inventors have found through experimentation that, as long as the correct hinge line has been provided for, additional hinge lines will not help or hurt the design. Thus, as long as the hinge placement seen in FIG. 2 is present, that is all that is needed although any number of other hinge lines can be added at any orientation in the forward or rear sole sections without affecting the design.

Figure 15:
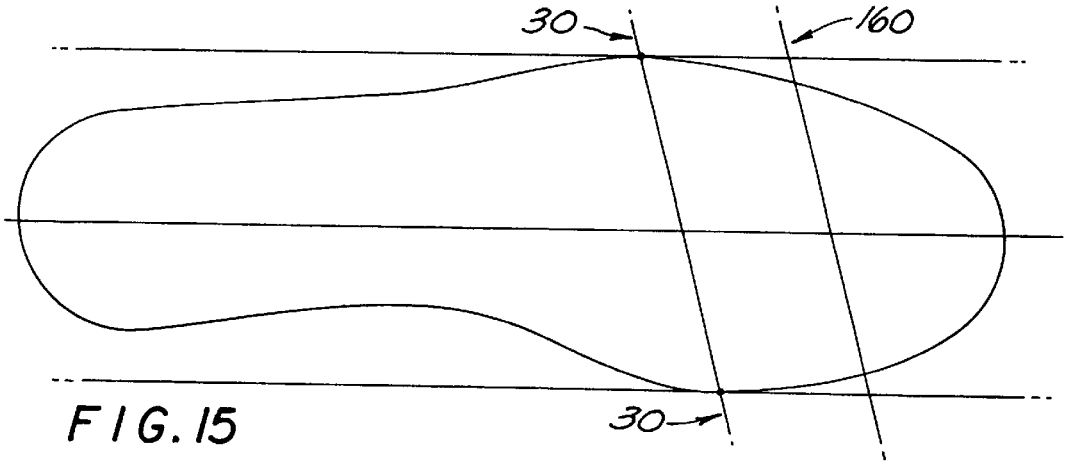
FIG. 15 shows a plan view of the shoe sole assembly of FIG. 2 with the addition of a superfluous hinge line.
Figure 16:
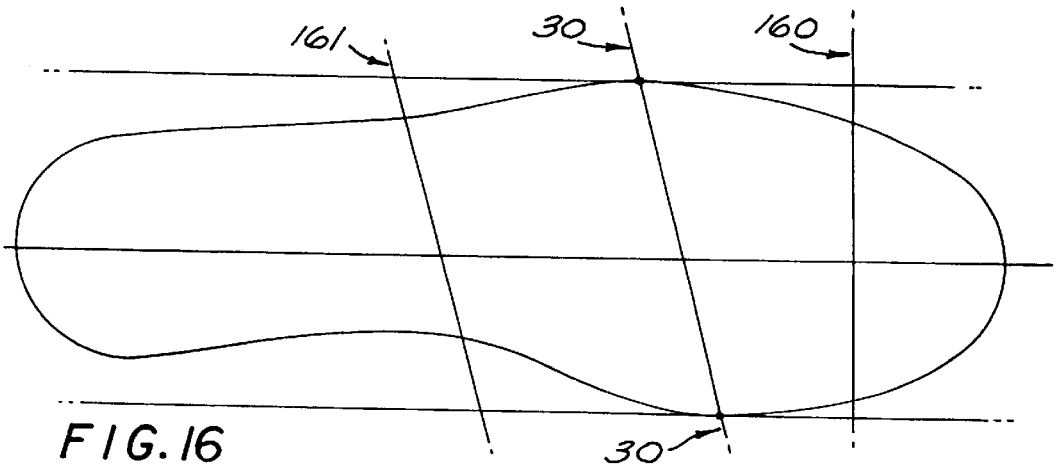
FIG. 16 shows a plan view of the shoe sole assembly of FIG. 2 with the addition of two superfluous hinge lines.

For example, FIG. 15 shows a plan view of the shoe sole assembly of FIG. 2 with the addition of the superfluous hinge line 160. It has been found that this provides no benefits and is more expensive to manufacture. FIG. 16 shows another variation with two superfluous hinge lines added. The designs in FIGS. 15 and 16 work just the way the design of FIG. 2 does. Hinge lines 160 and 161 have been found to provide no benefit and are thus 30 superfluous. Conversely, if the correct hinge line is not provided for as in FIG. 2, no other combination of hinge lines will work.

Figure 14:
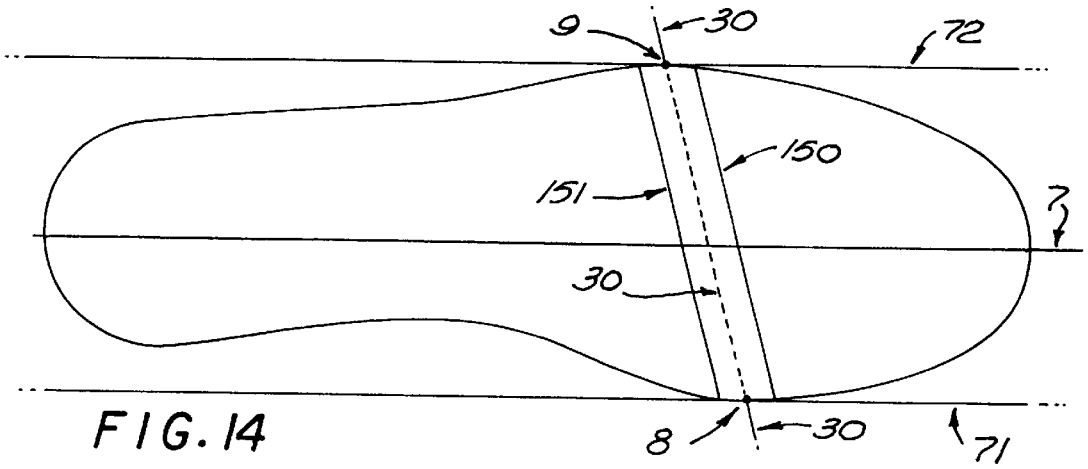
FIG. 14 shows a plan view of a shoe sole assembly with two hinge lines bracketing the correct line.

FIG. 14 shows a design where the correct hinge line has been bracketed by hinge lines 150 and 151. If the two lines are very close together, the result is almost the same as if the correct line has been provided for. Nonetheless, this design is much more difficult to manufacture than the design shown in FIG. 2.

The term "hinge means" has been used to describe any sort of hinge or folding device which allows the rear sole section to pivot with respect to the forward sole section by rotating axially about the hinge line without being able to twist laterally with respect to the hinge line.

Figure 10:
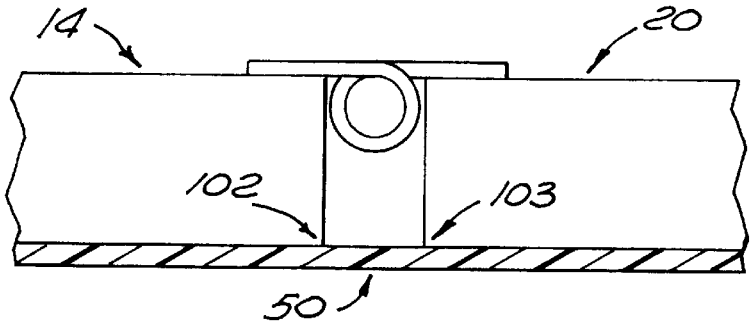
FIG. 10 shows a side sectional view of an experimental shoe sole assembly that was found not to work properly.

The inventors conducted experiments with all the hinge embodiments disclosed in the inventor's prior patent. It was hoped that the hinge construction shown in FIG. 10C would prove durable because it is the cheapest and easiest to make. Unfortunately, testing revealed that after a couple of weeks of wear, the rigid components 14 and 20 cut through portions of the flexible components 88 and 90. The embodiment shown in FIGS. 11A and 11B required that the sole sections be made very thick so that the hinge barrels 92 and the hinge shafts 94 could be manufactured with the precision required to make a working hinge mechanism. The thinnest sole sections that could be used for this embodiment were still so thick that the weight was prohibitive. The manufacturing expense was also too great for this method of making the hinge to be feasible. Incidentally, FIG. 1 of Baron discloses a similar hinge embodiment although the hinge placement is incorrect as was explained above.

We claim:

1. A shoe having a hinged sole assembly comprising:

a forward sole section having an upper surface and a lower surface and a rear edge and a most forward point; and a rear sole section having an upper surface and a lower surface and a forward edge and a most rearward point; and a hinge connecting said rear sole section to said forward sole section in pivotable connection along a straight hinge line; and a horizontal hinge gap having a separation distance between the rear edge of said forward sole section and the forward edge of said rear sole section; and a sole perimeter having a most medial point and a most lateral point, and wherein a reference line passing through the most forward point of said forward sole section and the most rearward point of said rear sole section defines a longitudinal axis, and wherein a medial reference line parallel to the longitudinal axis passes through the most medial point of said sole perimeter defining one point on the sole perimeter through which the hinge line of said hinge passes, and wherein a lateral reference line parallel to the longitudinal axis passes through the most lateral point of said sole perimeter defining the other point on the sole perimeter through which the hinge line of said hinge passes, and wherein said hinge means is positioned between said forward sole section and said rear sole section such that said horizontal hinge gap is equal to the thickness of said sole sections.

2. A shoe for receiving and supporting a foot of a wearer having a hinged sole assembly comprising:

a forward sole section having an upper surface and a lower surface and a rear edge and a most forward point; and a rear sole section having an upper surface and a lower surface and a forward edge and a most rearward point; and a hinge connecting said rear sole section to said forward sole section in pivotable connection along a straight hinge line; and a horizontal hinge gap having a separation distance between the rear edge of said forward sole section and the forward edge of said rear sole section, and wherein said hinge passes under the lowest point of the first metatarsal head and the lowest point of the fifth metatarsal head of the wearer's foot, and wherein said hinge is positioned between said forward sole section and said rear sole section such that said horizontal hinge gap is equal to the thickness of said sole sections.

* * * * *